US006922956B2

(12) United States Patent
Johnson et al.

(10) Patent No.: US 6,922,956 B2
(45) Date of Patent: Aug. 2, 2005

(54) FLOATING COVER

(75) Inventors: Burton M. Johnson, Warren, PA (US); William L. Wagner, Warren, PA (US)

(73) Assignee: Petrex, Inc., Warren, PA (US)

( * ) Notice: Subject to any disclaimer, the term of this patent is extended or adjusted under 35 U.S.C. 154(b) by 283 days.

(21) Appl. No.: 10/230,070

(22) Filed: Aug. 29, 2002

(65) Prior Publication Data

US 2002/0195449 A1 Dec. 26, 2002

Related U.S. Application Data

(63) Continuation-in-part of application No. 09/877,253, filed on Jun. 11, 2001, now Pat. No. 6,505,445.

(51) Int. Cl.[7] ..... E04H 7/04

(52) U.S. Cl. ..... 52/192; 52/20; 52/223.3; 220/216; 220/220

(58) Field of Search ..... 52/192, 223.3, 52/19–21; 220/216, 220

(56) References Cited

U.S. PATENT DOCUMENTS

| | | | | |
|---|---|---|---|---|
| 1,819,401 A | * | 8/1931 | Bailey | 220/218 |
| 2,237,461 A | | 4/1941 | Tokheim | |
| 3,374,918 A | | 3/1968 | Creith | |
| 3,724,704 A | | 4/1973 | Edwards et al. | |
| 3,774,799 A | | 11/1973 | Heisterberg | |
| 3,815,775 A | * | 6/1974 | Strunc et al. | 220/220 |
| 3,861,555 A | * | 1/1975 | Nelson | 220/221 |
| 3,910,452 A | | 10/1975 | Szasz | |
| 3,944,113 A | | 3/1976 | Heisterberg | |
| 3,980,199 A | | 9/1976 | Kays | |
| 4,036,394 A | | 7/1977 | Bodley et al. | |
| 4,130,216 A | * | 12/1978 | Creith | 220/224 |
| 4,202,460 A | | 5/1980 | Imbeault | |
| 4,213,280 A | | 7/1980 | Sandborn | |
| 4,243,151 A | | 1/1981 | Bruening | |
| 4,244,487 A | * | 1/1981 | Kern | 220/216 |
| 5,628,421 A | | 5/1997 | Jolly | |
| 5,704,509 A | | 1/1998 | Rosenkrantz | |
| 6,193,092 B1 | | 2/2001 | Witter | |
| 6,505,445 B2 | * | 1/2003 | Johnson et al. | 52/223.3 |
| 2003/0042256 A1 | * | 3/2003 | Johnson et al. | 220/216 |

* cited by examiner

*Primary Examiner*—Carl D. Friedman
*Assistant Examiner*—Yvonne M. Horton
(74) *Attorney, Agent, or Firm*—Robert E. Bushnell, Esq.

(57) ABSTRACT

A floating cover or roof having a plurality of floating panels or panels is provided. The floating cover disposed in a storage tank includes a frame having a plurality of openings, the floating panels mounted into the respective openings, an inspection port formed on an upper member of the floating panel and communicated with an inside of the floating panel. The inspection port provides for inspection for the presence of moisture, vapor, and condensate trapped in the inside of each of the floating panels without disassembly of adjacent floating panels, and also provides for the replacement of a damaged or degraded one among the floating panels without taking the internal floating roof out of the storage tank.

23 Claims, 11 Drawing Sheets

FLOATING COVER

CROSS-REFERENCE TO RELATED APPLICATIONS

This application is a continuation-in-part of Applicant's Ser. No. 09/877,253 filed in the U.S. Patent & Trademark Office on 11 Jun. 2001 now U.S. Pat. No. 6,505,445, and assigned to the assignee of the present invention.

BACKGROUND OF THE INVENTION

1. Field of the Invention

The present invention relates to a floating cover for a liquid storage tank, and more particularly, to a liquid surface contact internal floating cover constructed with a plurality of floating panels, and a process for monitoring leaks within each of the floating panels.

2. Description of the Background Art

Floating covers have previously been used inside cylindrical liquid storage tanks to ride vertically along the cylindrical wall of the tanks between the roof and bottom as the volume of fluid held by the tank varies. Typically, the floating cover floats above the liquid and moves up and down depending on the amount of the liquid. A plurality of buoyant panels or honeycomb type pans are assembled to form the floating cover. This conventional floating cover, however, is expensive to manufacture and erect inside the frame of the tank. Accordingly, periodic inspection and maintenance of the cover is desirable in order to obtain the full life of the cover.

The current design for full surface contact floating covers uses honeycomb panels that are manufactured by bonding an aluminum channel frame to the honeycomb panel. The honeycomb panel may have all sealed cells or all interconnected cells. If some of the cells of an individually sealed honeycomb are opened to invasion of the product held by the tank, there is currently no way of detecting the invasion except by observation of the escaped product as it drips out of the panel after the tank has been taken out of service and emptied. The trapped liquid will, however, slowly drip out of the panel and present a grave safety hazard to the maintenance people working within the interior of the tank. If a cell of an interconnecting cell type of honeycomb panel is violated, then all cells are violated, making it almost impossible to find the original leaking cell. The whole panel must be replaced.

The owners and managers of tanks must periodically inspect the interior of the tank and make repairs. This entails a removal of the contents of the tank, a purging of gaseous phase vapors from the interior of the tank, an introduction of ambient atmospheric air into the interior of the tank, and continuous or at least intermittent monitoring of the atmosphere within the interior of the tank. The owner of the tank needs assurance that, before personnel enter the interior of the empty tank, and while work (particularly using arc or open flame torches) is performed within the interior of the tank, the tank has been completely emptied and cleaned, and is safe for both the personnel and the type of work being performed. This assurance requires that there be no remaining hazardous pockets of the contents of the tank within the floating roof.

Currently, contemporary designers of buoyant panels provide no convenient technique for detecting the presence of moisture and condensate within individual buoyant panels.

SUMMARY OF THE INVENTION

It is an object of the present invention to provide an improved floating roof.

It is another object to provide a floating roof and process for detecting the presence of vapor, moisture, or condensate which indicates a leakage and the onset of deterioration of the integrity of the roof.

It is still another object to provide a floating roof assembled from multiple panels and a process for inspecting individual panels for the onset of deterioration.

It is yet another object to provide a floating cover able to remove and replace individual floating panels of a frame for the floating cover without interfering with the integrity of adjacent floating panels.

It is still yet another object to provide a floating cover that permits inspection of a leakage of each of the floating panels forming the floating cover without disassembly of the floating cover.

It is a further object to provide a full liquid surface contact internal floating cover constructed with individual floatation panels that maybe checked for a leakage from the top side of the cover while the tank is in service.

It is still another object to provide a full liquid surface contact internal floating cover that accommodates vapor sampling of the entire interior volume of the floatation panels.

It is yet a further object to provide a full liquid surface contact internal floating cover assembled from floatation panels set into the frame of the cover from the top side of the floating roof.

It is a still yet further object to provide a full liquid surface contact internal floating cover assembled from a plurality of floatation panels, with adjacent panels allowing unrestricted removal of individual floatation panels.

It is also an object to provide a full liquid surface contact internal floating cover with a frame for support of discrete floatation panels that is constructed from rigid structural members.

It is also an object to provide a full liquid surface contact internal floating cover constructed from a plurality of floatation panels that are not relied upon for the structural rigidity of the cover and therefore are not subjected to failure due to metal fatigue.

It is also an object to provide a full liquid surface contact internal floating cover constructed from a plurality of floatation panels that may be leak tested at the point of manufacture as well as in the field after assembly of the cover.

It is also an object to provide a floating cover that allows individual panels within the floating cover to be inspected without detaching either the particular panel being inspected or any adjacent panel from the floating cover.

These and other objects may be achieved by providing a storage tank with a floating cover including a frame having a plurality of openings, a plurality of floating panels mounted into the respective openings in the frame, an inspection port formed on an upper member of each of the floating panels that, when opened, communicates with a hollow cavity interior of the floating panel, and a cap covering the inspection port of the floating panel. The presence of moisture and condensate contained in any of floating panels can be visually detected through the inspection port of each of the floating panels without disassembling any of the floating panels or without removing the entire floating cover from the storage tank.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
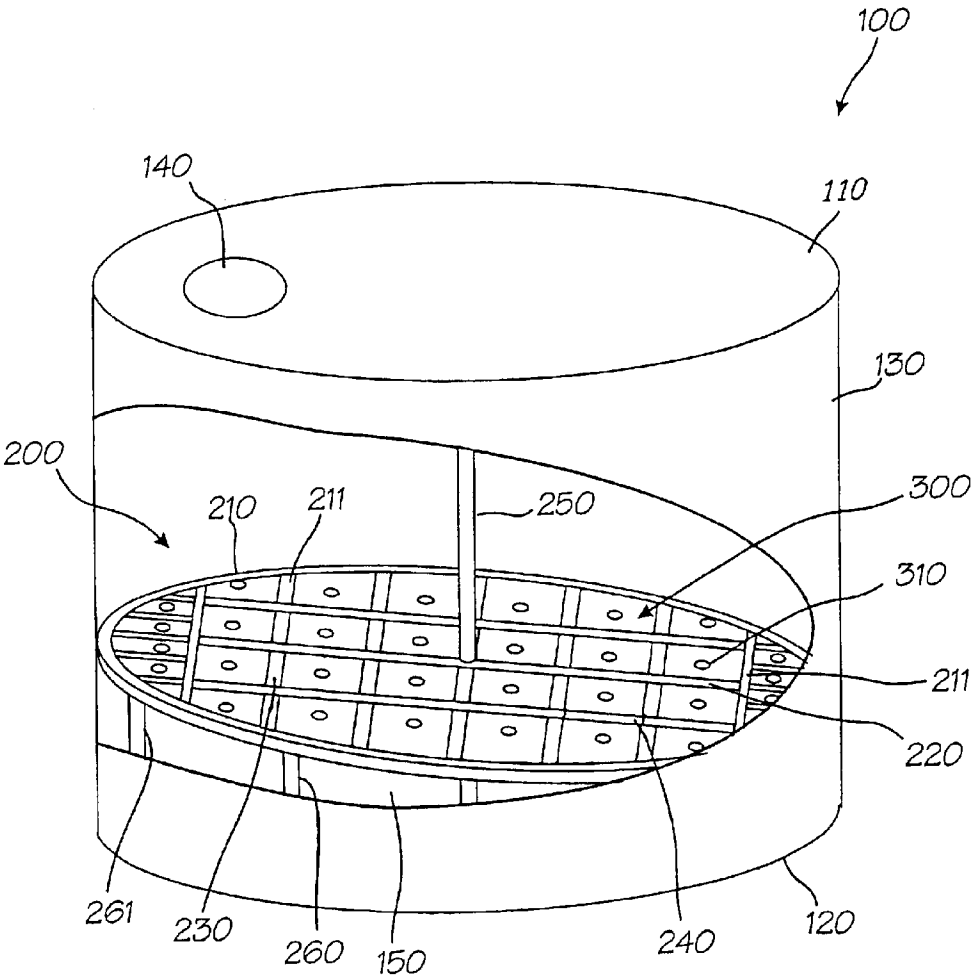
FIG. 1 is a perspective view of a storage tank with a broken wall showing a floating cover constructed according to the principles of the present invention.

Turning now to the drawings, FIG. 1 illustrates a storage tank 100 defining a roof 110, a bottom 120, and a hollow cylindrical wall 130, that is provided with a floating cover 200 constructed according to the principles of the present invention. A passage 140 is formed on roof 110 of storage tank 100 and provides an easy access into floating cover 200 contained inside storage tank 100. A plurality of girders 220, main beams 230, and cross beams 240, such as "H" shaped steel beams or "I" steel beams, are connected inside a circular rim 210 while a plurality of floating panels 300 are mounted onto respective individual separated openings provided among girders 220, main beams 230, and cross beams 240. A central post 250 is installed on a central portion of floating cover 200, and a plurality of rim legs 261 and main legs 260 are mounted on rim 210 and girders 220, respectively, in order to support floating cover 200 within storage tank 100. Floating cover 200 floats over the full surface of liquid 150 that fills the space provided between the underside of the floating cover 200 and bottom 120 of storage tank 100. Floating cover 200 moves up and down together with the surface of liquid 150 as a function of the volume of fluid within tank 100.

Since each bottom of floating panels 300 of floating cover 200 is lower than the level of the liquid 150 contained in storage tank 100, and since roof 110 may be damaged to the point of leaking, moisture and condensate, as well as some of the product stored within the tank, may be present in an inside of one or each of floating panels 300 through damaged seams or a crack usually in the underside of the panel. An inspection port 310 formed on each of floating panels 300 that is shown in greater detail provides each of floating panels 300 with the inspection of each of floating panels 300 for a leakage without disassembly of any of the adjacent floating panels 300.

Figure 2A:
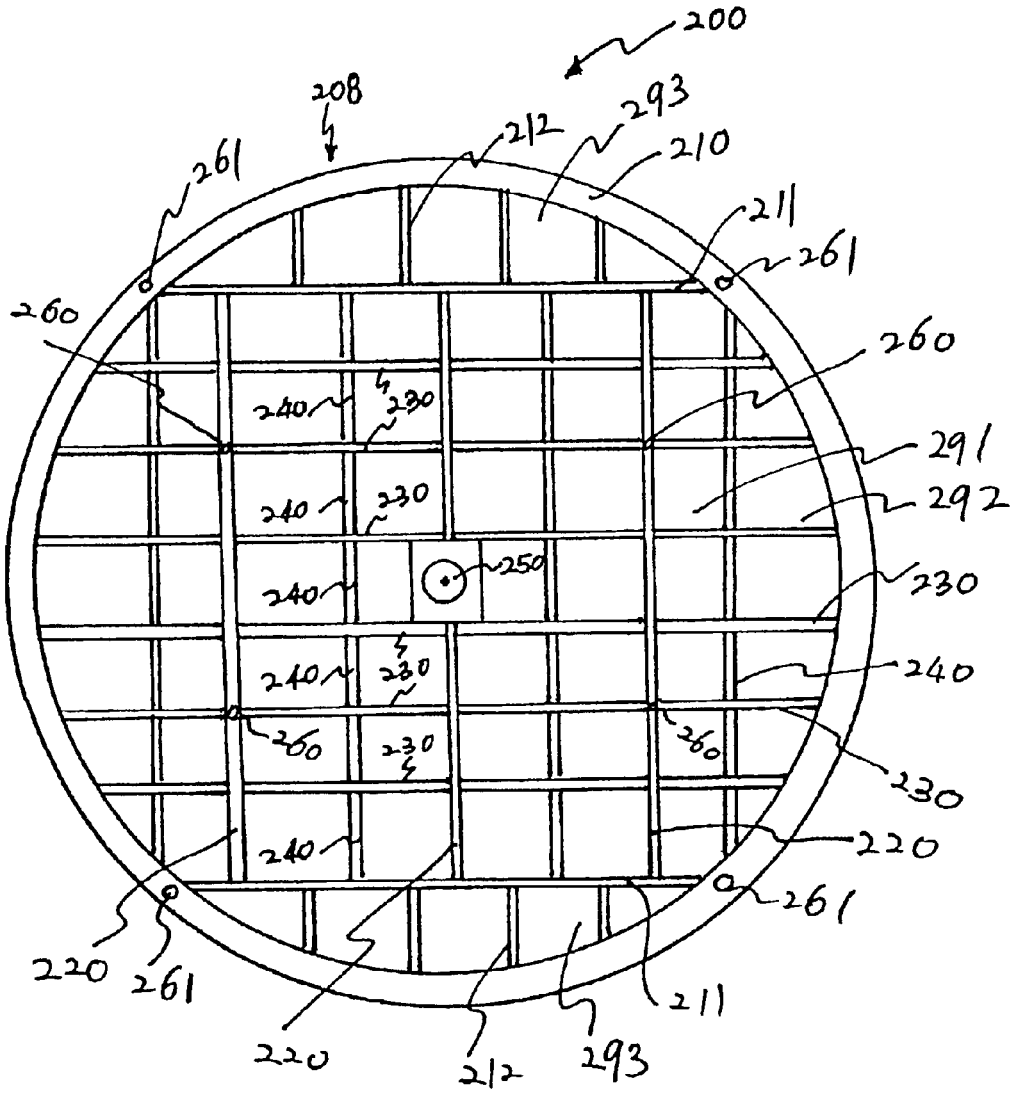
FIGS. 2A through 2D show a frame structure of the floating cover of FIG. 1.

FIG. 2A shows a plan view of a frame 208 including a rim 210, a pair of side beams 211 coupled to rim 210, a plurality of girders 220 connected between side beams 211, a plurality of main beams 230 coupled between girders 220, and a plurality of cross beams 240 coupled between main beams 230 and between side beam 211 and rim 210. Central post 250 is mounted on one of girders 220, and main legs 260 and rim legs 261 are mounted on girders 220 and rim 210, respectively, and protrude toward bottom 120 of storage tank 100. Cross beams 240 are parallel to each other while main beams 230 are perpendicular to both cross beams 240 and girders 220 and are parallel to side beams 211. Openings 291, 292, 293 showing a plurality of different shapes are provided by cross beams, girders 220, and main beams 230 or by rim 210, cross beams 240, and side beams 211. The shape of floating panels 300 corresponds to each of different shape of openings 291, 292, 293.

Figure 2B:
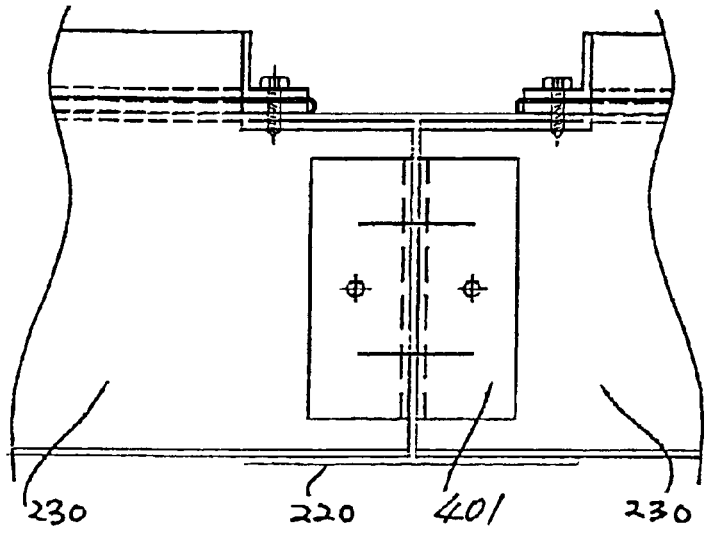
Figure 2C:
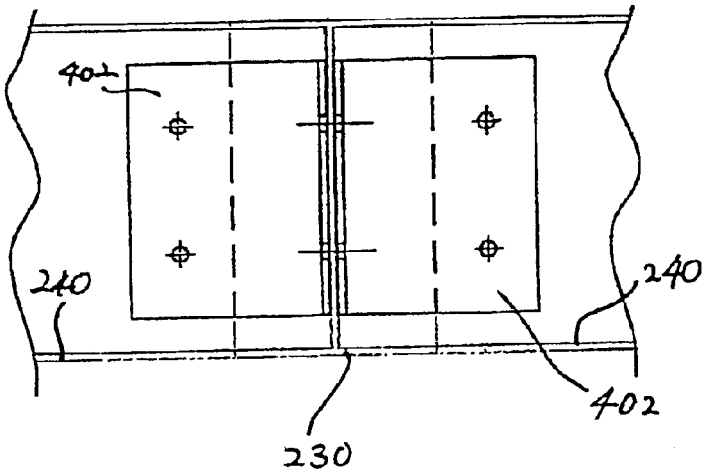
Figure 2D:
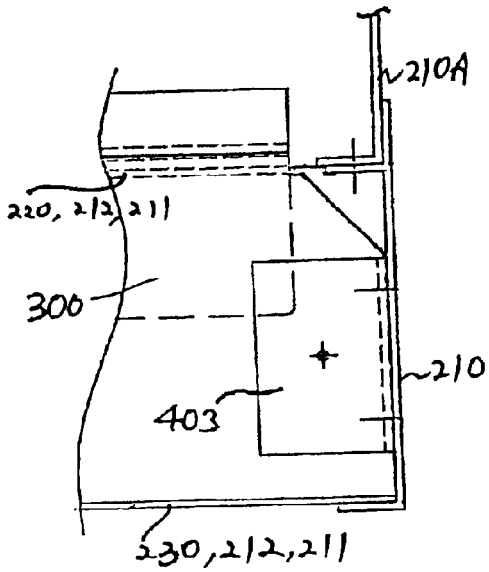

FIGS. 2B through 2D show angles 401, 402, 403 coupled between girder 220 and main beam 230, between main beam 230 and cross beam 240, and between rim 210 and main beam 220, side beam 211, or cross beam 212, 240, respectively. Two webs of girder 220 and main beam 230 are coupled by a pair of angles 401 as shown in FIG. 2B. Two webs of main beam 230 and cross beam 240 are spaced-apart from each other and coupled by a pair of angles 402 as shown in FIG. 2C. One of main beam 230, side beam 212, and cross beam 212, 240 may be coupled to rim 210 by angle 403. A rim extension 210A is extended upward from rim 210. Floating unit 300 is coupled to a flange of main beam 230, side beam 211, or cross beam 211, 240.

Figure 3:
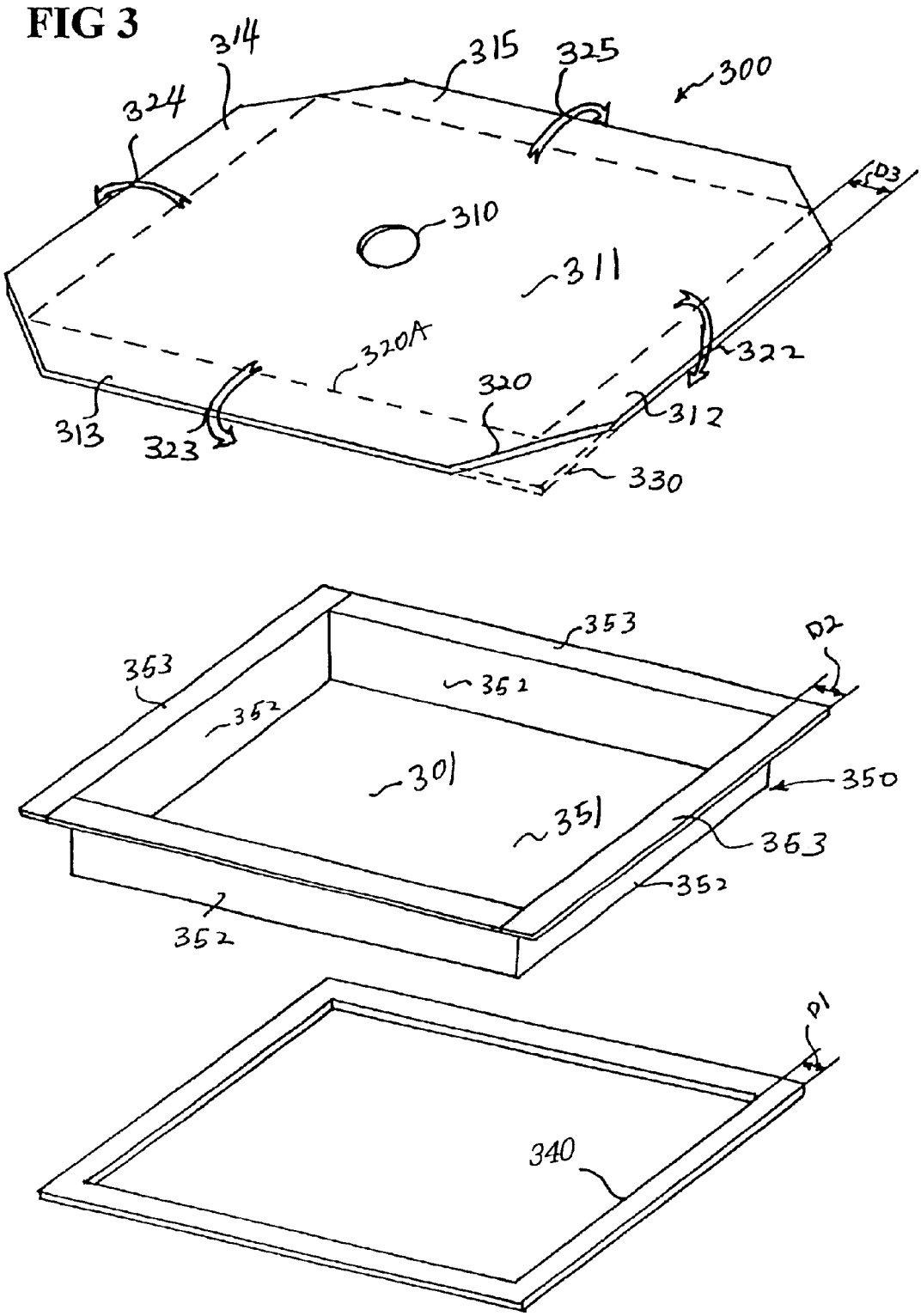
FIG. 3 is an exploded perspective view of a floating panel in the floating cover of FIG. 2.

FIG. 3 shows floating panel 300 including a lower member 350 defining a bottom 351, four side walls 352 having a predetermined depth, and extensions (or flanges) 353 extended from each longitudinal end of side walls 352 by a length D2. A rubber or bush 340 having a length D1 can be disposed on a bottom side of extension 353 of lower member 350. An upper member 311 includes an inspection port 310 and four end covers 312, 313, 314, 315 disposed on the outer peripheral sides of upper member 311 to be bent about a broken line 320A in a direction 322, 323, 324, and 325, respectively. A length D3 of end cover is greater than those of the rubber 340 and extensions 353. Four cutout portions 330 are formed at each corner of upper member 311 by a cutout line 320 in order to allow end covers 312, 313, 314, 315 to be bent in the direction 322, 323, 324, 325, respectively.

Figure 4:
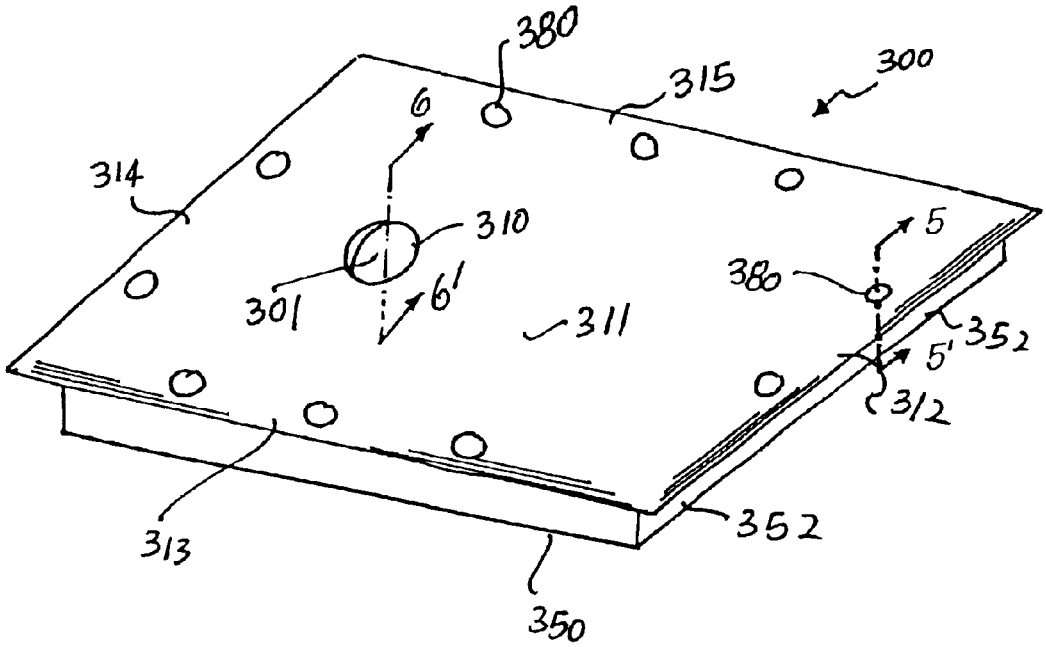
FIG. 4 is a perspective view of the floating panel of FIG. 3.

Upper member 311 is placed on extensions 353 of lower member 350, and end covers 312, 313, 314, 315 are folded in the direction 322, 323, 324, 325, respectively in order to cover extensions 353 and rubber 340. Once upper member 311, lower member 350, and rubber 340 are assembled into floating panel 300, coupling holes 380 are formed on each side of floating panels 300 as shown in FIG. 4. Upper member 311 is spaced apart from bottom 351 of lower member 350 in order to provide a hollow inside 301 which may be communicated with an outside of floating panels 300 through inspection port 310. Rubber 340 may be disposed between extensions 353 and end covers 312, 313, 314, 315.

Figure 5A:
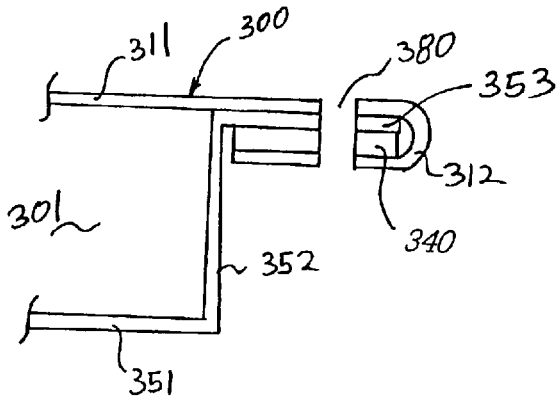
FIG. 5A is a partial cross-sectional view taken along line 5–5' of FIG. 4.
Figure 5B:
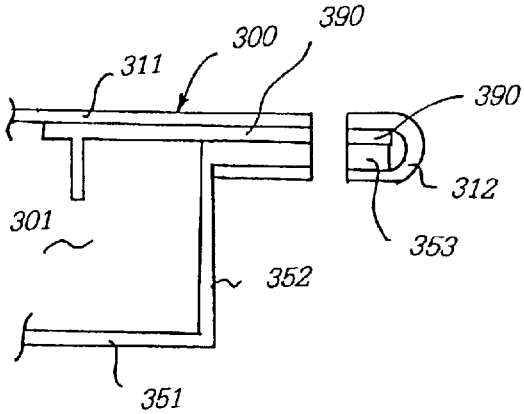
FIG. 5B is a partial cross-sectional view where a tee is inserted.
Figure 6:
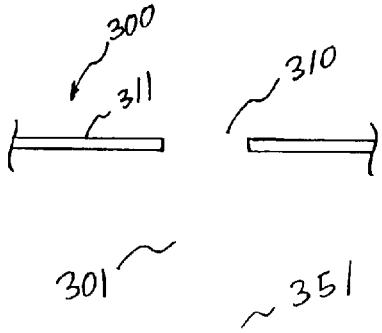
FIG. 6 is a partial cross-sectional view taken along line 6–6' of FIG. 4.

FIG. 5A shows floating panel 300 having end cover 312 bent in the direction 322 and surrounding extension 353 of lower member 350 and rubber 340. Instead of rubber 340, an internal tee 390 can be disposed between extensions 353 and end covers 312, 313, 314, 315 or between extension 353 and upper member 311. (See FIG. 5B). Coupling hole 380 is formed through end cover 312 of upper member 311, extension 353 of lower member 350, and tee 390. FIG. 6 shows a cross sectional view taken along 6–6' of FIG. 4. Upper member 311 is spaced apart from bottom 351 of lower member 350, and a sealed hollow inside 301 is provided between upper member 311 and bottom 351 of lower member 350. Each inspection port 310 provides a passageway between hollow inside 301 and an outside of floating panel 300.

Figure 7:
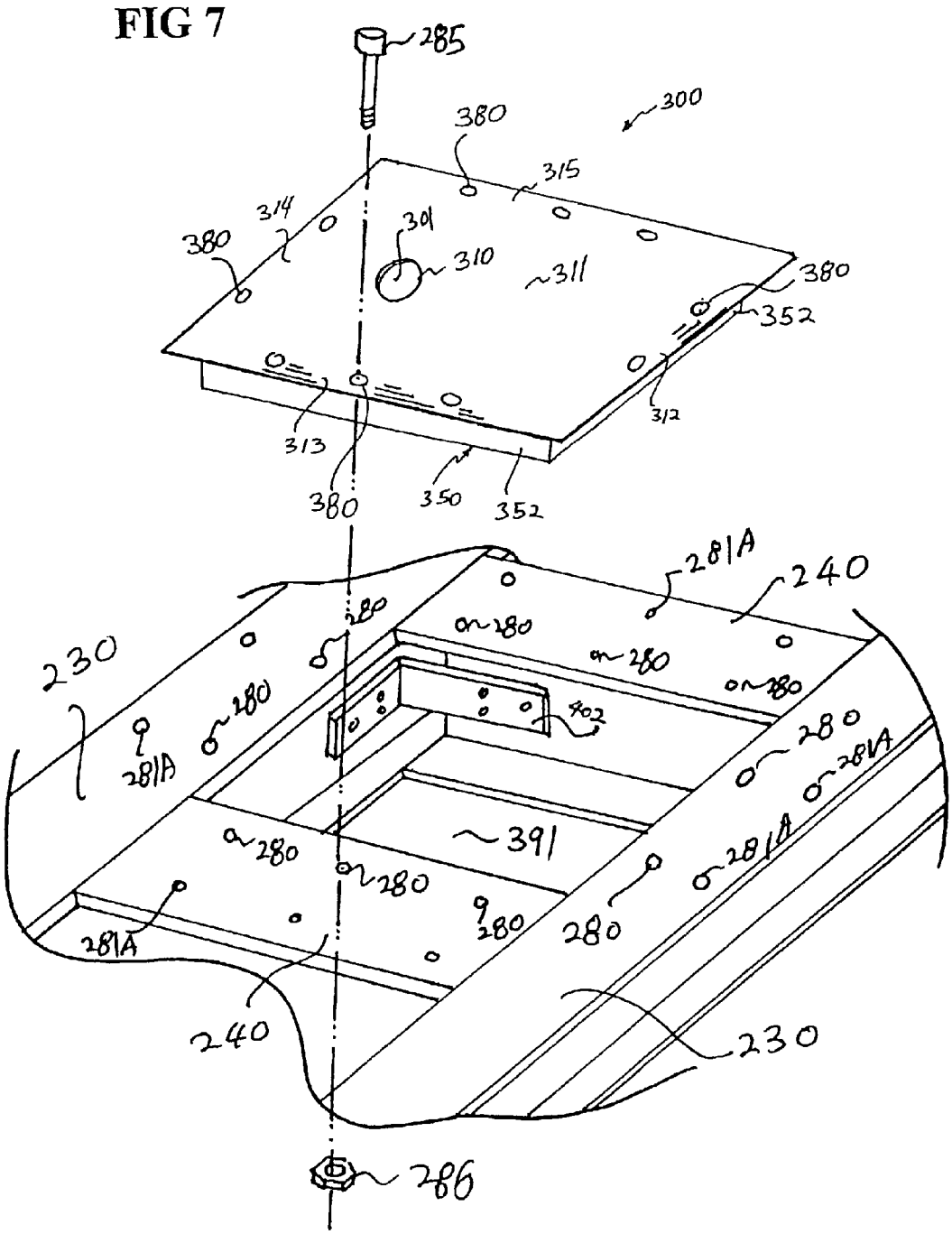
FIG. 7 is an exploded perspective view of a frame of the structure for the floating cover and a complete floating panel assembled with the frame structure.
Figure 8:
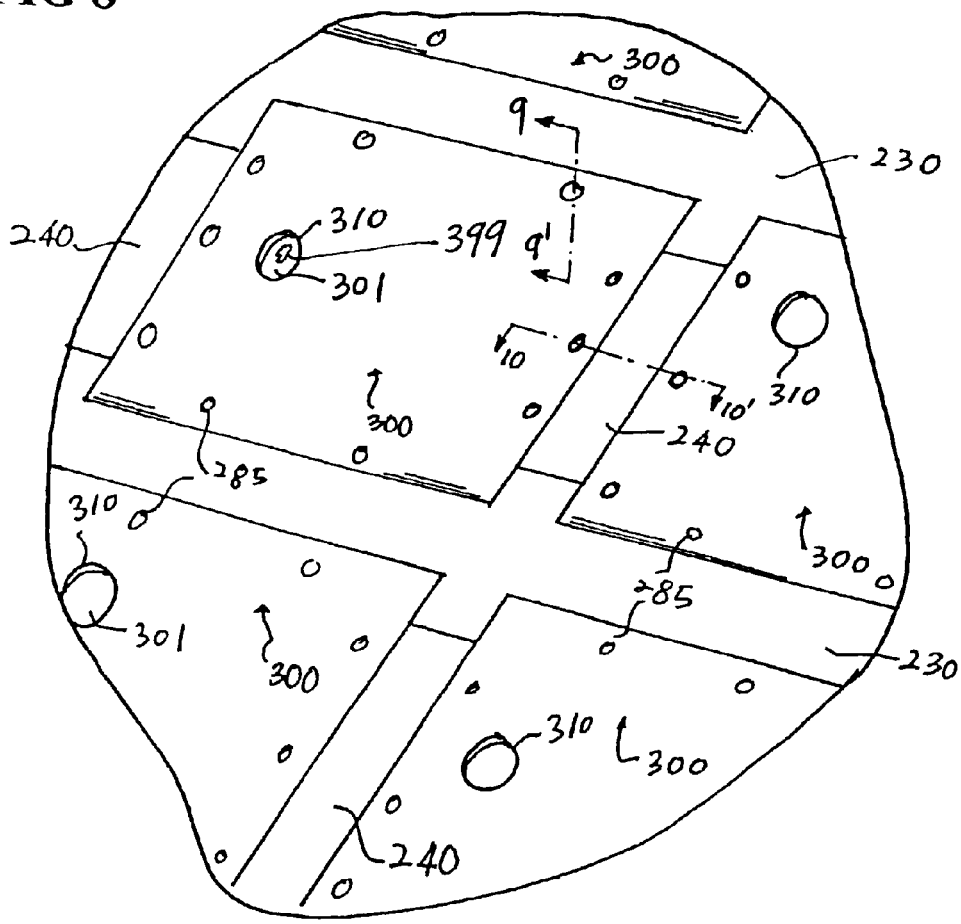
FIG. 8 is a partial perspective view of the floating cover formed by an assembly of a plurality of the floating panels.

FIGS. 7 and 8 show floating panels 300 inserted into respective openings 391 and coupled to main beams 230 and cross beams 240. A plurality of first coupling holes 280 are formed on main beams 230 and cross beams 240 for coupling one of floating panels 300 to main beams 230 and cross beams 240. A plurality of second coupling holes 281A is formed on main beams 230 and cross beams 240 and spaced apart from first coupling holes 280. Adjacent floating panels 300 are coupled to main beams 230 and cross beams 240 through second coupling holes 281A. An angle 402 is disposed between cross beam 240 and main beam 230 to attach cross beam 240 to main beam 230. Various types of couplers 401, 402, 403 maybe used for coupling side beams 211 to rim 210, girders 220 to side beams 211, main beams 230 to girders 220, and cross beams 240 either between main beams 220 or between rim 210 and side beams 211. A bolt 285 passes through coupling holes 380 and 280 or 281A to be coupled to a nut 286 in order to attach each of floating panels 300 to main beams 230 and cross beams 240.

FIG. 8 shows the floating panels of FIG. 4 assembled into frame 208 of floating cover 200. Each individual inspection port 310 is shown in each of the individual floating panels inserted into respective openings 291 and attached to main beams 230 and cross beams 240. Each of the floating panels is spaced apart from adjacent floating panels, and is coupled to main beams 230 and cross beams 240 without being coupled to the adjacent floating panel, and without interfering with the assembly of the adjacent floating panels. During attachment of one of the floating panels 300 to main beams 230 and cross beams 240, or during detachment of one of the floating panel 300 from main beams 230 and cross beams 240, the one of the floating panels 300 does not interfere with the adjacent floating panels. One of floating panels 300 is replaced with a new one without disassembling the adjacent floating panels from main beams 230 and cross beams 240 of frame 208 of floating cover 200.

Since hollow inside 301 of floating panel 300 communicates with the outside of floating panels 300 through each individual inspection port 310, bottom 351 of lower member 350 of floating panels 300 can be seen through individual inspection port 310. Individual inspection port 310 is formed at a predetermined position on upper member 311 in order to provide a passageway through which an inspection tool is inserted into hollow inside 301 of floating panel 300 or to inspect bottom 351 of lower member 350. Inspection port 310 may be used for sniffing the interior of floating panel 300 with the inspection tool, such as a gas vapor monitor, instead of trying to look through inspection port 310. Individual inspection port 310 may be formed on a central portion or a corner portion of upper member 311 depending on a user's selection. Therefore, inspection port 310 is disposed to allow a user to inspect hollow inside 301 with any of naked eyes and the inspection tool. A plurality of inspection ports may be formed on upper member 311 in order to provide the user with the full inspection of the entire inside 301 of floating panels.

In FIG. 8, moisture and condensate 399 in one of floating panels 300 become visible through inspection port 310. If one of roof 110 and floating cover 200 is damaged, if the seam of each of floating panels 300 of floating cover 200 is broken, or if the seal of sealant is loosened, moisture and condensate 399 are present in hollow inside 301 of floating panels 300 and accumulate in bottom 351 of lower member 350 of floating panels 300. The disassembly of any of floating panels 300 from frame 208 of floating cover 200 is not needed. A user may inspect for the presence of the moisture and condensate 399 through inspection port 310 formed on each of floating panels 300 without disassembly of any of floating panels 300 or any of adjacent floating panels 300. Moreover, the floating cover 200 does not need to be taken out from the storage tank 100.

Since the coupling of one floating panel to beams does not affect the coupling of the adjacent floating panels to beams of frame 208, the processing time for assembling floating panels to beams is shortened, and the cost of manufacturing floating panels and assembling the floating cover is significantly reduced. Moreover, it is very convenient and very advantageous for a user to replace a damaged floating panel with a new floating panel, thereby reducing the time and cost for the replacement of the damaged floating panels.

Since floating panels 300 and frame 208 are separately manufactured in a factory or in different factories at different locations, and are assembled into floating cover 200 inside storage tank 100, each of floating panels 300 may be individually inspected in the factory and also individually inspected before and after floating panels 300 are assembled. Each inspection of floating panels 300 in both sites of the factory and storage tank 100 before and after the assembly of the floating cover 200 is more great advantageous for the user and manufacturer.

Figure 9:
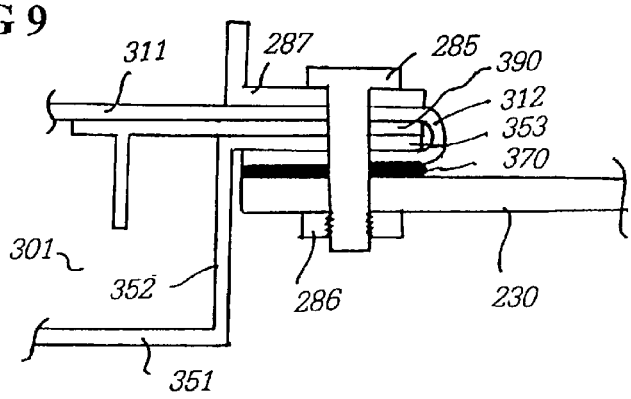
FIG. 9 is a partial cross-sectional view taken along line 9–9' of FIG. 8.
Figure 10:
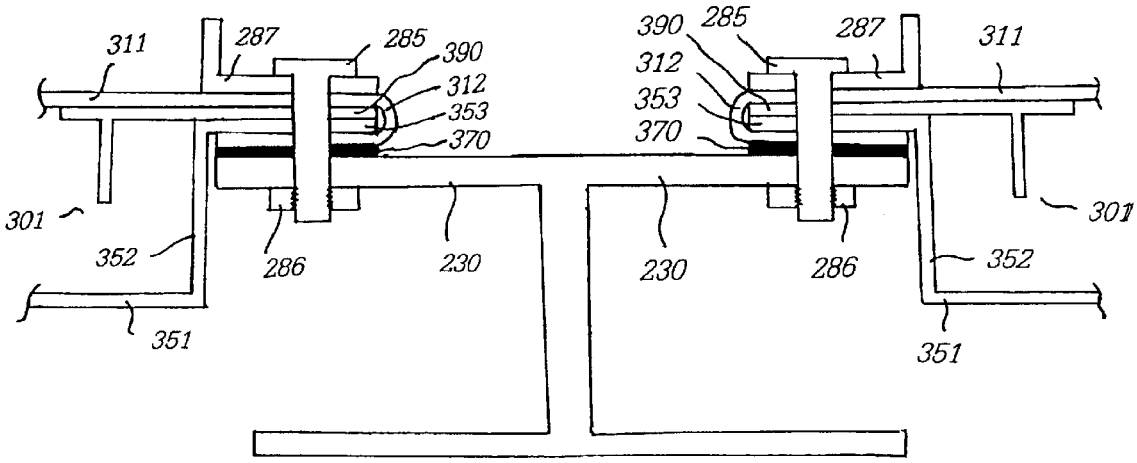
FIG. 10 is a partial cross-sectional view taken along line 10–10' of FIG. 8.

FIGS. 9 and 10 show a partial cross sectional view taken along lines 9–9' and 10–10' of FIG. 8, respectively. Floating panel 300 is coupled to main beam 230 by bolt 285 and nut 286. A bush 287 is inserted between bolt 285 and end cover 312 of upper member 311 and may be inserted between end cover 312 and main beam 230 or between main beam 230 and nut 286. Tee 390 is inserted between the upper side of extension 353 and the bottom side of upper member 311. Sealant 370 is disposed between floating panels 300 and main beam 230 to prevent a leakage. For example, polythioether polymer such as PR-3300 can be used as a sealant.

In FIG. 10, two adjacent floating panels 300 are coupled to each of horizontal extensions of cross beams 240 and spaced apart from each other. Because each floating panel includes each individual hollow inside and each individual inspection hole, each individual floating panel can be inspected while adjacent individual floating panel maintains a coupling state to girders 220, main beams 230, or cross beams 240.

Figure 11A:
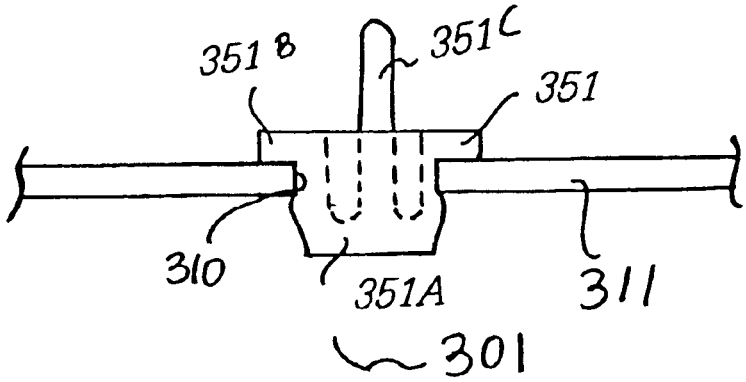
FIGS. 11A and 11B are partial cross-sectional views of a cap mounted on an inspection port of an upper member of the floating panel constructed according to the principles of the present invention.
Figure 11B:
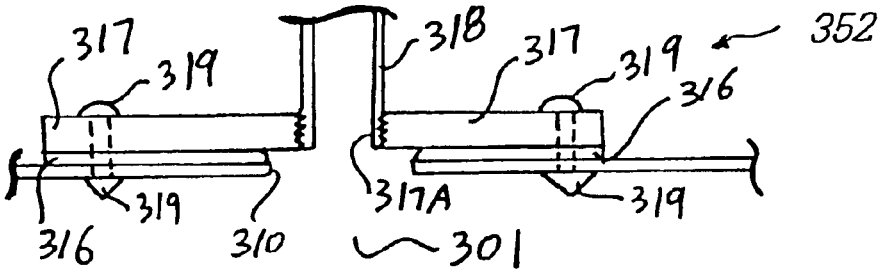
Figure 12:
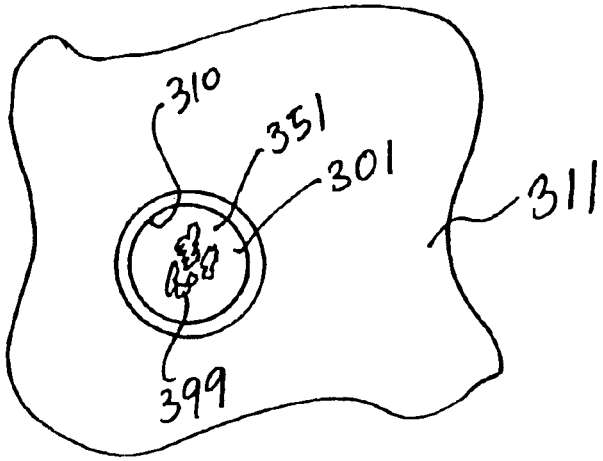
FIG. 12 is a partial plan view showing moisture and condensate found in the floating panel through the inspection port.

FIGS. 11A and 11B show various types of mechanisms, such as plastic plugs, elastic rubber plugs, adhesive tapes, and pipes. A removable plug as shown in FIG. 11A is inserted into inspection port 310 in order to close and open inspection port 310 of upper member 311 and in order to prevent foreign material from being introduced into hollow inside 301 of floating panel 300. Plastic plug 351 defines a main body 351A inserted into hollow inside 301 through inspection port 310 and having a diameter greater than inspection port 310, a stopper 351B radially extending from main body 351A, and a handle 351C protruding from main body 351A toward an outside of floating unit 300. In FIG. 11B, an additional member 351A is removably mounted on upper member 311 when upper member 311 is not thick enough to couple an air line or pipe to inspection port 310. A thicker plate 317 couples an air line or pipe to inspection port 310. A thicker plate 317 is coupled to upper member 311 by couplers 319. A sealant 316 is disposed between upper member 311 and plate 317. A removable air line or pipe 318 is fitted into a second port 317A. FIG. 12 shows moisture and condensate 399 contained and accumulated in floating panel 300, and visible through inspection port 310. Inspection port 310 may have a circular shape, an elongate shape, or an elliptical shape. The shape of plug 351 or 352 varies depending on the shape of inspection port 310.

Figure 13:
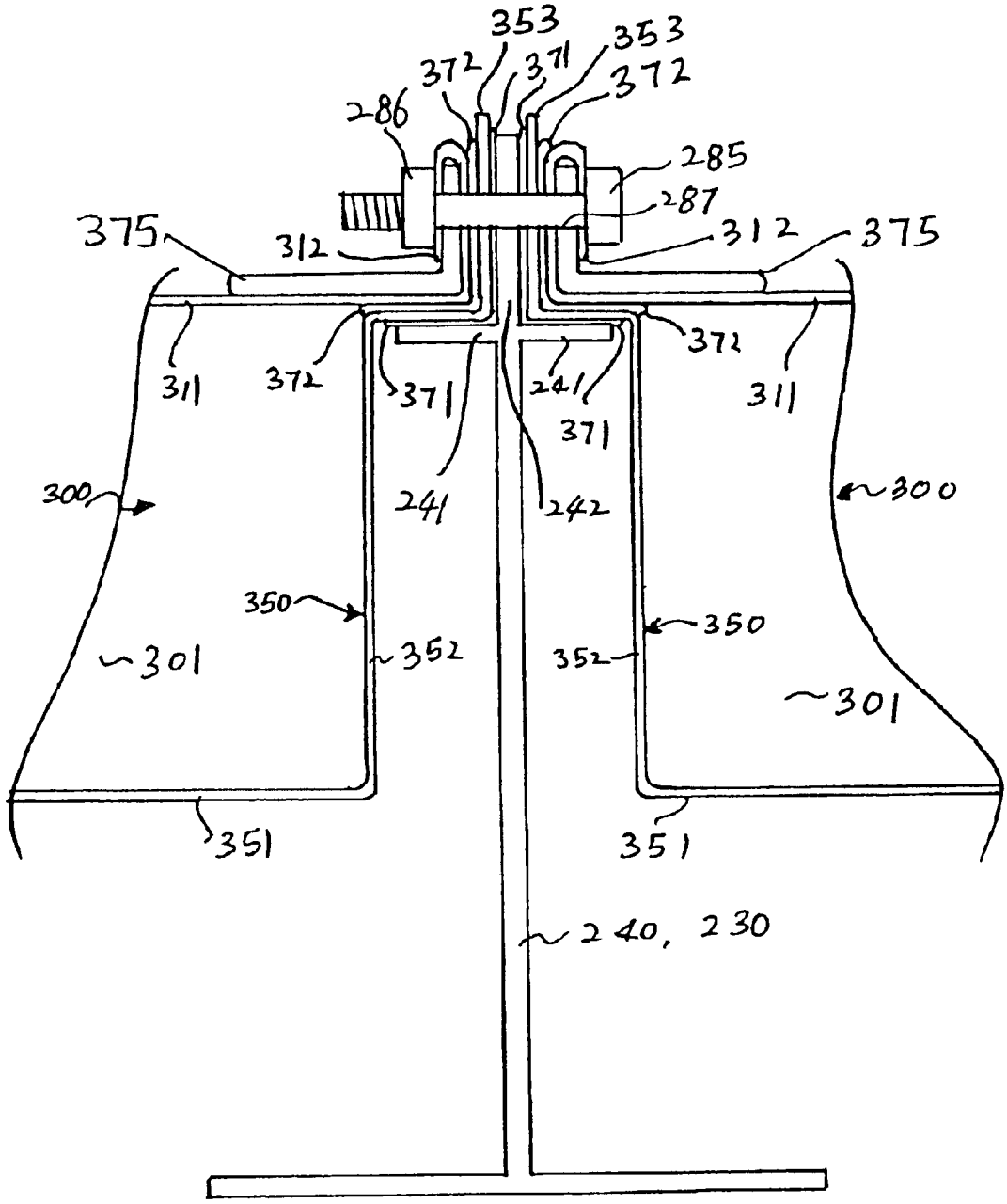
FIG. 13 is another embodiment of the floating cover coupled to the frame structure.

FIG. 13 shows another embodiment of the coupling between floating covers 300 and main beam 230 or cross-beam 240. Adjacent floating panels 300 are disposed on respective extensions 241 with respect to a flange 242 of beam 230, 240. A first sealant 371 is disposed between extension 353 of lower member 350 and both extension 241 and flange 242 of beam 230, 240. A second sealant 372 is disposed between extension 353 of lower member 350 and end cover 312 of upper member 311. End cover 312 is bent to cover an auxiliary angle 375. Bolt 285 is coupled to nut 286 through a connecting hole 287 formed on flange 242, first sealant 371, extension 353 of lower member 350, second sealant 372, end cover 312 of upper member 311, and auxiliary angle 375. Although adjacent floating panels 300 are coupled to beam 230, 240, the inspection for the presence of vapor, moisture, and condensate is established through inspection port 310 formed on respective floating panels 300 without disassembling adjacent floating panels 300. Even if one of floating panels 300 is violated, the one of floating panels 300 can be replaced only with the decoupling of bolt 285 and nut 286 from connecting hole 289. Adjacent floating panels 300 remain in respective openings 291, 292, 293 of floating cover 200 during replacement of the one of adjacent floating panels 300.

As mentioned above, the floating cover or roof is provided with a plurality of floating panels or panels each having a respective inspection port constructed according to the principle of the present invention. With the inspection port, damaged or degraded floating panels or panels may be inspected and replaced without decoupling the adjacent floating panels from the floating cover, and without taking the floating cover or roof out of the storage tank. The entire floating cover does not need to be replaced. Rather, the damaged and degraded one among the floating panels is replaced with a new floating panel after a convenient inspection for the presence of moisture and condensate trapped in the trough or the inside of each floating panels through each inspection port formed on each of floating panels or panels.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan being folded around said flange, said upper pan having a hole for a visual inspection into an inside of said container, said lower pan and said upper pan being attached to said frame by a fastener;

a sealant disposed between said frame and said panels to prevent a leakage; and a central post mounted in a central portion of said floating cover.

2. The floating cover of claim 1, further comprising a plurality of legs attached to one of said rim and said beams to support said floating cover within said storage tank.

3. The floating cover of claim 1, wherein each of said panels is coupled to said frame without interfering with the assembly of an adjacent panel from said frame.

4. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan being folded around said flange, said upper pan having a hole for a visual inspection into an inside of said container, said lower pan and said upper pan being attached to said frame by a fastener;

a sealant disposed between said frame and said panels to prevent a leakage; and a plurality of legs attached to one of said rim and said beams to support said floating cover within said storage tank.

5. The floating cover of claim 4, wherein each of said panels is coupled to said frame without interfering with the assembly of an adjacent panel from said frame.

6. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan bding folded around said flange, said upper pan having a hole for a visual inspection into an inside of said container, said lower pan and said upper pan being attached to said frame by a fastener;

a sealant disposed between said frame and said panels to prevent a leakage; and a plug removably inserted into said hole to close said hole and prevent foreign materials from being introduced into said container.

7. The floating cover of claim 6, said plug comprising a main body inserted into said hole, a stopper extended from said main body, and a handle protruding from said stopper toward an outside of said panel.

8. The floating cover of claim 6, wherein each of said panels is coupled to said frame without interfering with the assembly of an adjacent panel from said frame.

9. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan being folded around said flange, said upper pan having a hole for a visual inspection into an inside of said container, said lower pan and said upper pan being attached to said frame by a fastener;

a sealant disposed between said frame and said panels to prevent a leakage;

a plate fastened to the upper pan, said plate having a port corresponding to said hole;

a sealant disposed between said plate and said upper pan to prevent a leakage; and a pipe coupled to said port.

10. The floating cover of claim 9, wherein each of said panels is coupled to said frame without interfering with the assembly of an adjacent panel from said frame.

11. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan being folded around said flange, said upper pan having a hole for a visual inspection into an inside of said container, said lower pan and said upper pan being attached to said frame by a fastener;

a sealant disposed between said frame and said panels to prevent a leakage; and a rubber inserted between said flange and said upper pan.

12. The floating cover of claim 11, wherein each of said panels is coupled to said frame without interfering with the assembly of an adjacent panel from said frame.

13. A floating cover in a storage tank, comprising:

a frame comprising a rim and a plurality of beams connected to said rim, said plurality of beams being connected with each other to form a plurality of discrete openings;

a plurality of panels, each of said panels covering each of said discrete openings, each of said panels comprising an upper pan and a lower pan, said lower pan comprising a container with a flange outwardly and transversely bent from said container, an exterior rim of said upper pan being folded around said flange, said upper pan having a hole for a visual inspection into an inside of said container, said lower pan and said upper pan being clamped to said frame with a fastener; and a tee inserted between said upper pan and said flange.

14. The floating cover of claim 13, further comprising a sealant disposed between said frame and said panels to prevent a leakage.

15. The floating cover of claim 13, said panels each being coupled to said beams without being coupled to an adjacent floating panel.

16. The floating cover of claim 14, further comprising a plug removably inserted into said hole to close said hole and prevent foreign materials from being introduced into said container.

17. The floating cover of claim 13, said plug comprising a main body inserted into said hole, a stopper extending from said main body, and a handle protruding from said stopper toward an outside of said panel.

18. The floating cover of claim 17, further comprising:

a plate fastened to the upper pan, said plate having a port corresponding to said hole;

a sealant disposed between said plate and said upper pan to prevent a leakage; and a pipe coupled to said port.

19. The floating cover of claim 13, said fastener being a bolt and a nut, said bolt being inserted into a hole formed through said panel, said frame, and said tee.

20. A process for a floating a cover, comprising the steps of:

providing a frame having a plurality of beams fabricated within said frame, said beams providing a plurality of separate and individual openings;

providing a plurality of panels, each having an upper panel member and a lower panel member, said upper panel member having a hole, said lower panel member having a bottom, side walls, and an extension extending from each longitudinal end of said side walls;

folding an exterior rim of said upper panel member around said extension to couple said upper panel member to said lower panel member;

covering said plurality of openings with said plurality of panels; and clamping said plurality of panels to said plurality of beams with fasteners without interfering with the clamping of adjacent panels.

21. The process of claim 20, further comprising the step of disposing a sealant between said plurality of panels and said frame to prevent a leakage.

22. The process of claim 21, further comprising the step of inserting a tee between said upper member and said extension.

23. The process of claim 22, further comprising the step of covering said holes with plugs.

* * * * *